United States Patent [19]

Kuboyama

[11] Patent Number: 4,596,077

[45] **Date of Patent: * Jun. 24, 1986**

[54] HEATING PROCESS AND ITS APPARATUS IN REDUCING AIR PRESSURE WITHIN A BALANCED LEVEL

[76] Inventor: Nobuyoshi Kuboyama, 28-9-1, Shimoniyamori Aza, Miyamori-Mura, Inate-ken, Japan

[ * ] Notice: The portion of the term of this patent subsequent to Jan. 24, 2001 has been disclaimed.

[21] Appl. No.: 505,765

[22] Filed: Jun. 20, 1983

[30] Foreign Application Priority Data

Jun. 23, 1982 [JP] Japan ..... 57-106680

[51] Int. Cl.[4] ..... F26B 5/04

[52] U.S. Cl. ..... 34/15; 34/39; 34/92; 126/247

[58] Field of Search ..... 34/15, 39, 42, 92; 126/247; 165/DIG. 12; 237/19

[56] References Cited

U.S. PATENT DOCUMENTS

| | | | |
|---|---|---|---|
| 3,140,929 | 7/1964 | Johanson | 34/92 |
| 3,698,378 | 10/1972 | Rosenberg et al. | 165/DIG. 12 |
| 4,143,639 | 3/1979 | Frenette | 126/247 |
| 4,319,408 | 3/1982 | Kuboyama | 34/15 |
| 4,342,422 | 8/1982 | Davis | 237/19 |
| 4,426,793 | 1/1984 | Kuboyama | 34/15 |

FOREIGN PATENT DOCUMENTS

| | | | |
|---|---|---|---|
| 57-104053 | 6/1982 | Japan | 126/247 |

*Primary Examiner*—Albert J. Makay
*Assistant Examiner*—Steven E. Warner
*Attorney, Agent, or Firm*—Thomas R. Morrison

[57] ABSTRACT

A heating process and its apparatus reduces air pressure within a chamber at a balanced level. The air retained within the chamber or the air suctioned through an outer air suction means is suctioned forcibly by rotation of rotary means disposed in the chamber and discharged outside the chamber through an inner air discharge means until air pressure within the chamber is reduced to a balanced level. Meanwhile, air friction heat is generated by continuous rotation of the rotary means, thereby the interior of the chamber is heated by air friction heat. Cooled outer air suctioned by the outer air suction means is heat-exchanged with heated air discharged by the inner air discharge means.

4 Claims, 4 Drawing Figures

HEATING PROCESS AND ITS APPARATUS IN REDUCING AIR PRESSURE WITHIN A BALANCED LEVEL

BACKGROUND OF THE INVENTION

This invention relates to a heating process and its apparatus in reducing air pressure within a chamber at a balanced level.

The origin of this invention is based on U.S. Pat. No. 4,319,408 entitled "Heating process and its apparatus in reducing air pressure within a chamber at a balanced level" which was invented by the present Applicant. Based upon the above basic U.S. Patent the Applicant has developed various related techniques and filed the corresponding U.S. patent applications Ser. Nos. 329,818, 349,064 now matured to U.S. Pat. No. 4,426,793 and 480,706. Referring to the principle of the aforesaid U.S. Patent and related techniques, the air within a chamber is suctioned forcibly and discharged thereoutside by rotation of rotary means disposed in the chamber. As a result, the air pressure therewithin gets reduced and after a short lapse of time a difference between a reduced air pressure within the chamber and a normal air pressure thereoutside is maintained at a balanced level. Under such circumstances, air friction heat is generated by continuous rotation of the rotary means, thereby the chamber inside is heated by air friction and can be utilized as a heat source. Further, if necessary, it is feasible to dry the wet articles incorporated in chamber by feeding a certain amount of outer air into the chamber manually or automatically. Accordingly, this technology is being highly evaluated because it can be applied widely for various industrial circles engaging in drying and heat generation.

When drying those wet articles, it will be very useful to carry out effectively without heat loss a drying treatment to discharge a heated gas containing an evaporated content equivalent to a certain quantity of cooled outer air suctioned from the outside which should be supplied into the chamber heated at reduced air pressure. From this point of view, this invention has been achieved.

BRIEF SUMMARY OF THE INVENTION

It is an object of this invention to provide a heating process and its apparatus in reducing air pressure within a chamber at a balanced level, wherein the outer air suction function and the inner air discharge function are simultaneously actuated in mutually opposite direction in the area of a heat exchange means. That is to say, a low temperature outer air to be suctioned from the outside is heat-exchanged with a high temperature inner air to be discharged. In other words, the former is absorbed by the latter, thereby a nearly complete heat exchange is carried out and heat loss is prevented. Accordingly, the temperature decrease of the chamber can be prevented.

When reducing continuously air pressure within a chamber at a balanced level while making the quantity of the outer air suction lesser than that of the inner air discharge, the air temperature of the chamber does not fall, but begins to rise. Accordingly, if a user wishes to decrease the temperature rapidly, it is required to supply a certain quantity of outer air into the chamber by installing one or more outer air introducing means therein. Particularly, when drying various kinds of wet articles, it is well-known that it is required to control the temperature condition of the chamber and the heating time to a desired level. Otherwise, the quality of the dried articles might be worsened.

It is another object of this invention to provide a heating process and its apparatus in reducing air pressure within a chamber at a balanced level, wherein even if the outer air is suctioned by the outer air suction means and the air within the chamber is communicated with the outer air, it is possible to continue to reduce air pressure within the chamber at a balanced level. Further, if necessary, it is possible to decrease the chamber temperature rapidly or discharge an evaporated water content of the chamber rapidly thereoutside by installing the outer air introducing means for supplying the outer air directly into the chamber.

Other and further objects, features and advantages of this invention will appear more fully from the following description taken in connection with the accompanying drawings.

BRIEF DESCRIPTION OF THE ACCOMPANYING DRAWINGS

FIG. 1 is a longitudinal section view of an example of a heating apparatus in reducing air pressure within a chamber at a balanced level according to this invention.

FIG. 2*a* is a partially cutaway rear view taken on line II—II of FIG. 1.

FIG. 2*b* is a partially enlarged section view of a heat exchange means of FIG. 2*a*.

FIG. 3 is a section view taken on line III—III of FIG. 1.

DETAILED DESCRIPTION OF THE INVENTION

Figure 1:
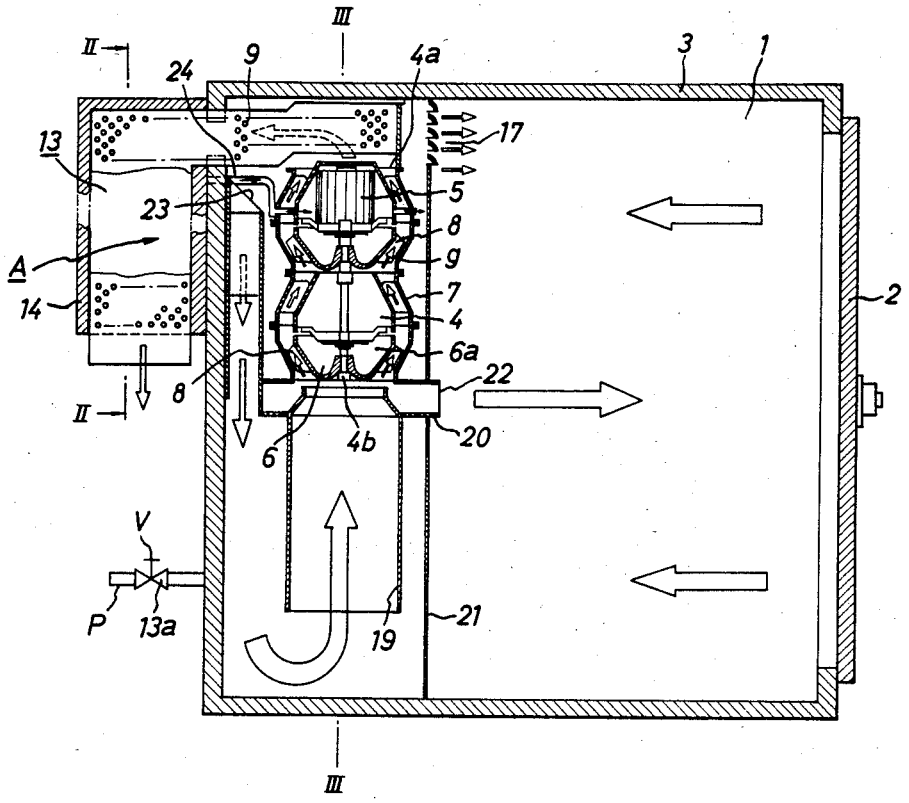
Figure 2A:
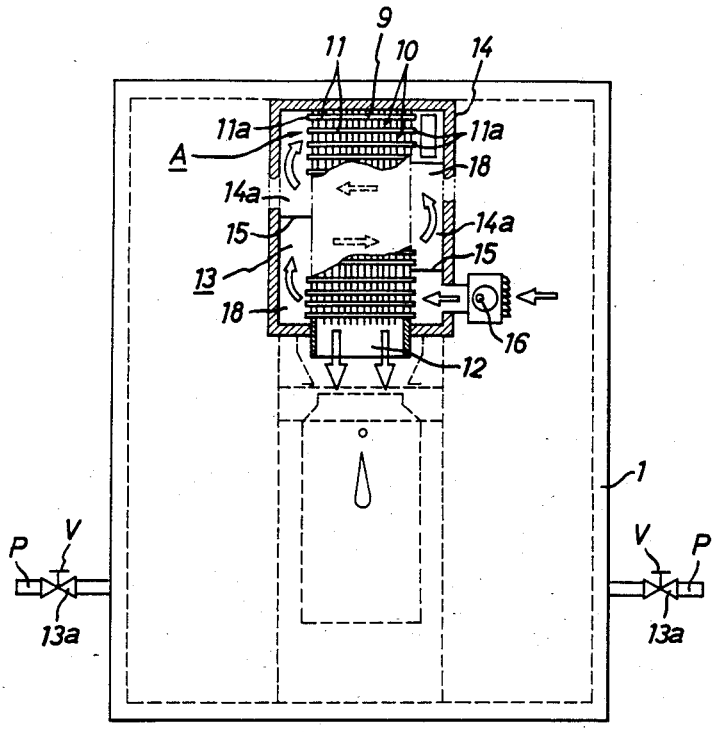
Figure 2B:
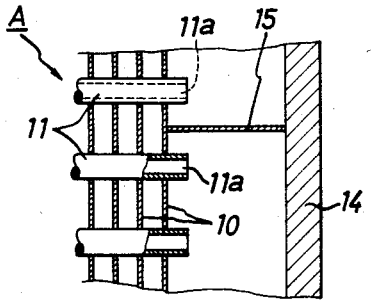
Figure 3:
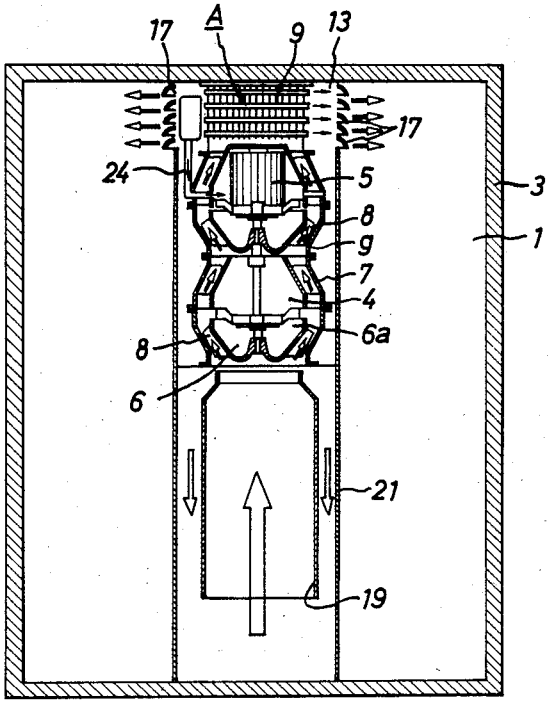

A preferred example of this invention will now be described with reference to the accompanying drawings.

Numeral 1 is a chamber which is closed by a door 2 and shielded by two external walls, between which is incorporated a heat insulating material 3. Numeral 4 is air friction heat generating means comprising a motor 5, one fan or a plurality of fans 6 and a cylinder 7 covering the fans 6. Between the fans 6 and the cylinder 7 is formed a slight gap g. Numeral 8 is air friction heat generating means which is formed in the space where the plurality of fans 6 are rotated. Owing to the slight gap g, the air friction effect is enhanced. It is of course optional to modify a size of the fan 6, the number of vanes 6*a*, an inclination of each vane 6*a*, a distance between adjacent fans 6, the number of fans 6, etc. As disclosed in U.S. patent application No. 480,706, the rotary means can be equipped with multistage fans. The fan 6 such as a propeller fan, a sirocco fan or the like comprises rotary vanes 6*a* which are provided with a certain inclination so as to suction and discharge the air within the chamber 1.

A heat exchange means A consisting of an inner air discharge means 9 and an outer air suction means 13 will now be described.

The inner air discharge means 9 is communicated with an opening 4*a* of the discharge side of the air friction heat generating means 4 and further communicated with the outside of the chamber 1.

The inner air discharge means 9 comprises a large number of heat exchange plates 10 in parallel with each other, a large number of heat exchange pipes 11 intersected with a right angle relative to the heat exchange plates 10 and a passage 12 formed outside the heat exchange pipes 11.

Outer air suction means 13 is incorporated integrally in the inner air discharge means 9. Numeral 14 is a tubular body formed outside the inner air discharge means 9, which comprises spaces 14*a*, 14*a* of two rows along both openings 11*a*, 11*a* of the large number of heat exchange pipes 11. In the spaces 14*a*, 14*a* of two rows are disposed a large number of partitions 15 biased with each other. Further, the tubular body 14 comprises a passage 18 formed in a zigzag type from a valve port 16 of the outer air suction means 13 toward an opening 17 communicating with the chamber 1, and such zigzag passage 18 is formed along the heat exchange pipes 11 and the partitions 15.

It is optional to open or close the valve port 16 of the outer air suction means 13 by a timer or manually in order to control the air temperature of the chamber 1. Numeral 13*a* is outer air introducing means connected directly with the chamber 1, which comprises a valve V controllable either manually or automatically and a pipe P. When it is required to decrease the air temperature in the chamber 1 rapidly, the valve V may be opened in accordance with the instructions of a controller (not illustrated). It is optional to connect a plurality of outer air introducing means 13*a* to the chamber 1.

Numeral 19 is an inner air introducing cylinder which is disposed below an opening 4*b* of the air suction side of the air friction heat generating means 4. Numeral 20 is an air circulating tube having an opening 22 communicated with the chamber 1. Numeral 21 is a partition wall for covering the air friction heat generating means 4. Numeral 23 is also an opening for circulating the inner air. Numeral 24 is a small-sized conduit for introducing outer air to prevent the motor 5 from overheating.

The heating process of this invention will now be described.

When the motor 5 is energized, a plurality of fans 6 are rotated and the air within the closed chamber 1 is suctioned forcibly and discharged thereoutside through the inner air discharge means 9 by the air suction and discharge function of the plurality of fans 6. As a result, the air pressure within the chamber 1 is gradually reduced. Then, a difference between a reduced air pressure within the chamber 1 and a normal air pressure thereoutside becomes larger gradually, but after a short lapse of time the difference therebetween is maintained at a balanced level.

In the reduced balanced air pressure within the chamber, an air retaining phenomenon is generated in the air friction heat generating area 8 in a rotation area of the fans 6. That is, the vanes 6*a* are rotated continuously in the slight gap g of the air friction heat generating area 8, air friction heat is generated and its temperature is gradually raised. The thus heated air friction heat is spread uniformly throughout the chamber 1 and the chamber may be heated at a desired temperature.

Accordingly, when wet articles are disposed within the chamber 1, an aqueous content in each article is removed by the air pressure reduction effect within the chamber 1. In addition to this, owing to the air friction heat effect, the chamber temperature is raised, thereby all the wet articles disposed in the chamber are heated. Thus, drying treatment of those articles, extract treatment of their water content or the like can be carried out efficiently.

When opening the valve port 16 of the outer air introducing means 13 by the timer or in view of the temperature of the chamber 1, the outer air is supplied and dispersed into the chamber 1 while meandering in a zigzag line by way of the passage 18 through the large number of heat exchange pipes 11 and the spaces 14*a*, 14*a* of two rows. Then, the quantity of the water containing gas in the chamber 1 which is equivalent to the introducing quantity of the outer air is discharged outside the chamber by way of the inner air discharge means 9 of the air friction heat generating means 4. When the discharge quantity of the heated inner air is more than the introducing quantity of the outer air, the degree of the air pressure reduction in the chamber 1 is decreased somewhat in comparing with the condition that the valve port 16 is sealed, but the air pressure reduction effect is maintained at a balanced level and the heat generation function is continued, thereby the temperature is raised.

When an operator wishes to decrease the chamber temperature speedily, the outer air can be fully introduced into the chamber by opening the valve V of the outer air introducing means 13*a*. Thus, the difference between the air pressure within the chamber 1 and the normal pressure thereoutside disappears and the chamber temperature can drop rapidly to a desired level.

According to a usual operation of this invention, the valve port 16 of the outer air introducing means 13 is first of all sealed.

In such a completely sealed condition, the air pressure within the chamber 1 is reduced at a balanced level. Subsequently, the valve port 16 is opened. Further, the valve V of the outer air introducing means 13*a* is opened. However, the chamber temperature can also be raised even in the condition that the valve port 16 of the outer air suction means 13 is opened in advance prior to operation, the air in the chamber is somewhat communicated with the outer air and consequently the degree of the air pressure reduction effect is lower than that in the completely sealed state of the chamber 1. And, the outer air introducing means 13*a* can be of course utilized for decreasing the chamber temperature.

Since the inner air discharge means 9 comprises a large number of heat exchange plates 10 and a large number of heat exchange pipes 11, the inner air heated in the chamber is effectively heat-exchanged with the outer air passed through the large number of heat exchange pipes 11 by way of the outer air suction means 13. As a result, a water content of the heated inner air is radiated and cooled, and it is removed completely as a coagulated water.

As shown in a number of arrows of FIG. 1, the air within the chamber 1 is effectively circulated by the arrangement of the inner air introducing cylinder 19, the circulation tube 20 and the side opening 23. Thus, the wet articles incorporated in the chamber 1 can be heated or dried efficiently.

According to one aspect of this invention, since the heat exchange means is formed by incorporating the outer air suction means integrally in the inner air discharge means, the outer air suction function and the inner air discharge function are actuated in mutually opposite direction, thereby a very efficient heat exchange is carried out. Thus, the temperature decrease of the chamber can be prevented.

Further, since the heat exchange is carried out effectively, the vaporized water content of the heated inner air can be coagulated and liquefied, thereby discharge of moist air is prevented. Thus, the heat exchange means is applicable for extraction of the water content or the like.

According to another aspect of this invention, by removing the outer air introducing means or by sealing the valve thereof, the chamber can be closed and heated in reducing air pressure therewithin at a balanced level. In addition, even if the chamber is communicated with outer air by introducing it thereinto by way of the heat exchange means through the outer air suction means, the chamber can be heated in reducing air pressure therewithin at the balanced level. Accordingly, the apparatus of this invention may be applied for drying, heating and other various industrial purpose by decreasing the chamber temperature rapidly by actuation of the outer air introducing means.

What is claimed is:

1. A heating process for heating the interior of a chamber at reduced air pressure, comprising:

forcibly suctioning the air retained within said chamber or the air suctioned through an outer air suction means by rotation of rotary means disposed in said chamber;

discharging said air through an inner air discharge means outside said chamber until air pressure within said chamber is reduced to a balanced level;

maintaining a difference between the reduced air pressure within said chamber and the air pressure outside said chamber at said balanced level;

generating air friction heat by continuous rotation of said rotary means and heating the interior of said chamber by said air friction heat;

permitting a first controlled amount of outside air to enter said chamber;

permitting a second controlled amount of inside air to discharge outside said chamber; and passing said first and second controlled amounts through a heat exchange whereby said first controlled amount of outside air is heated and said second controlled amount of inside air is cooled.

2. A heating process for heating the interior of a chamber at reduced air pressure, comprising:

forcibly suctioning the air retained within said chamber or the air suctioned through an outer air suction means by rotation of rotary means disposed in said chamber;

discharge said air through an inner air discharge means outside said chamber until air pressure within said chamber is reduced to a balanced level;

maintaining a difference between the reduced air pressure within said chamber and the air pressure outside said chamber at said balanced level;

generating air friction heat by continuous rotation of said rotary means and heating the interior of said chamber by said air friction heat;

permitting a first controlled amount of outside air to enter said chamber;

permitting a second controlled amount of inside air to discharge outside said chamber;

passing said first and second controlled amounts through a heat exchanger whereby said first controlled amount of outside air is heated and said second controlled amount of inside air is cooled; and permitting a third controlled amount of outside air to enter directly into the interior of said chamber by way of an outer air introducing means without passing through said heat exchanger.

3. A heating apparatus comprising:

a sealable chamber having outer air introducing means for introducing outer air directly into said chamber;

rotary means disposed within said chamber for reducing air pressure in said chamber to a reduced balance level by forcibly suctioning the air retained in said chamber through an inner air discharge means adjacent said rotary means and discharging said air outside said chamber;

said rotary means being effective to maintain a difference between the reduced air pressure within said chamber and the air pressure outside said chamber at said reduced balance level and to heat the interior of said chamber;

a heat exchanger;

an outer air suction means;

means for permitting a first controlled flow of outside air to flow through said outer air suction means to said heat exchanger; and means for permitting a second controlled flow of inner air to flow through said inner air discharge means and said heat exchanger whereby said first controlled flow is heated by heat exchange with said second controlled flow.

4. The heating apparatus as claimed in claim 3, further comprising means for permitting a third controlled flow of outer air to enter said chamber without passing through said heat exchanger.

* * * * *